United States Patent [19]

Bredlau

[11] 4,066,265

[45] Jan. 3, 1978

[54] AMUSEMENT DEVICE

[76] Inventor: Kenneth A. Bredlau, 15675 LaBella Court, Morgan Hill, Calif. 95037

[21] Appl. No.: 712,782

[22] Filed: Aug. 9, 1976

[51] Int. Cl.[2] ..... A63F 9/06

[52] U.S. Cl. ..... 273/153 R; 35/62; 273/113

[58] Field of Search ..... 273/153 R, 113; 35/62

[56] References Cited

U.S. PATENT DOCUMENTS

| | | | |
|---|---|---|---|
| 426,569 | 4/1890 | O'Shaughnessy | 273/153 R |
| 2,011,266 | 8/1935 | Boynton | 273/153 R |
| 3,179,414 | 4/1965 | Mertz et al. | 273/130 D |
| 3,642,191 | 2/1972 | Roof | 35/62 |

*Primary Examiner*—Anton O. Oechsle
*Attorney, Agent, or Firm*—Huebner & Worrel

[57] ABSTRACT

An amusement device characterized by a transparent envelope having substantially planar sides, and a maze card of a substantially planar configuration having a maze defined thereon, adapted to be received in the envelope, including means defining along the opposite faces thereof a singular path extended between the periphery and the center of the maze and passing at least once through the card. In one embodiment the path is traced on the surface of the envelope employing a marking device, while in an alternate embodiment the path is defined in the card by a gated channel and a ball is seated in the channel and adapted to roll along the path as it traverses along its length.

2 Claims, 7 Drawing Figures

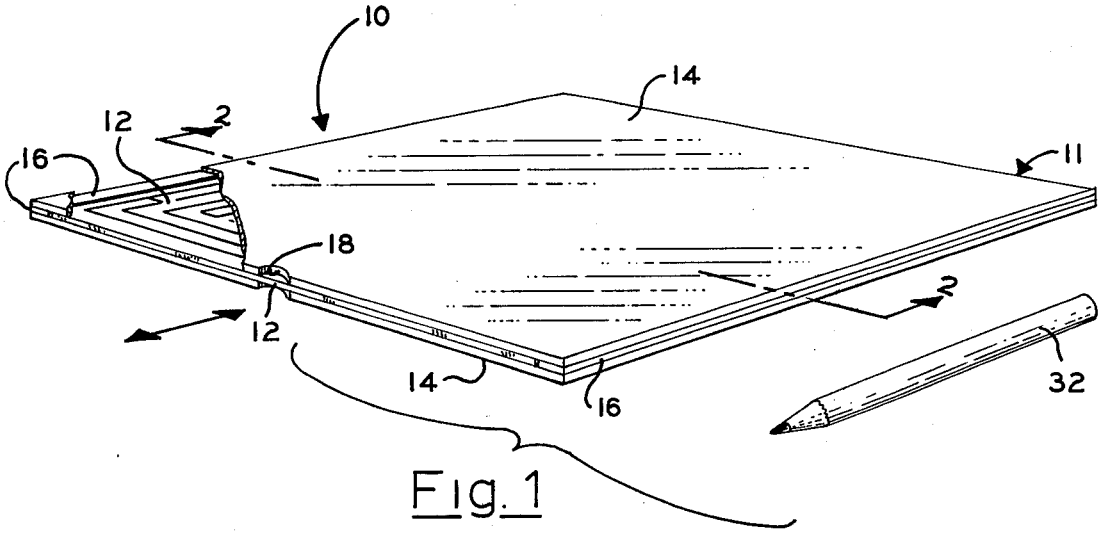
Fig. 1
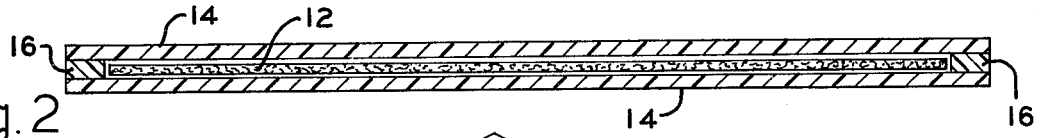
Fig. 2
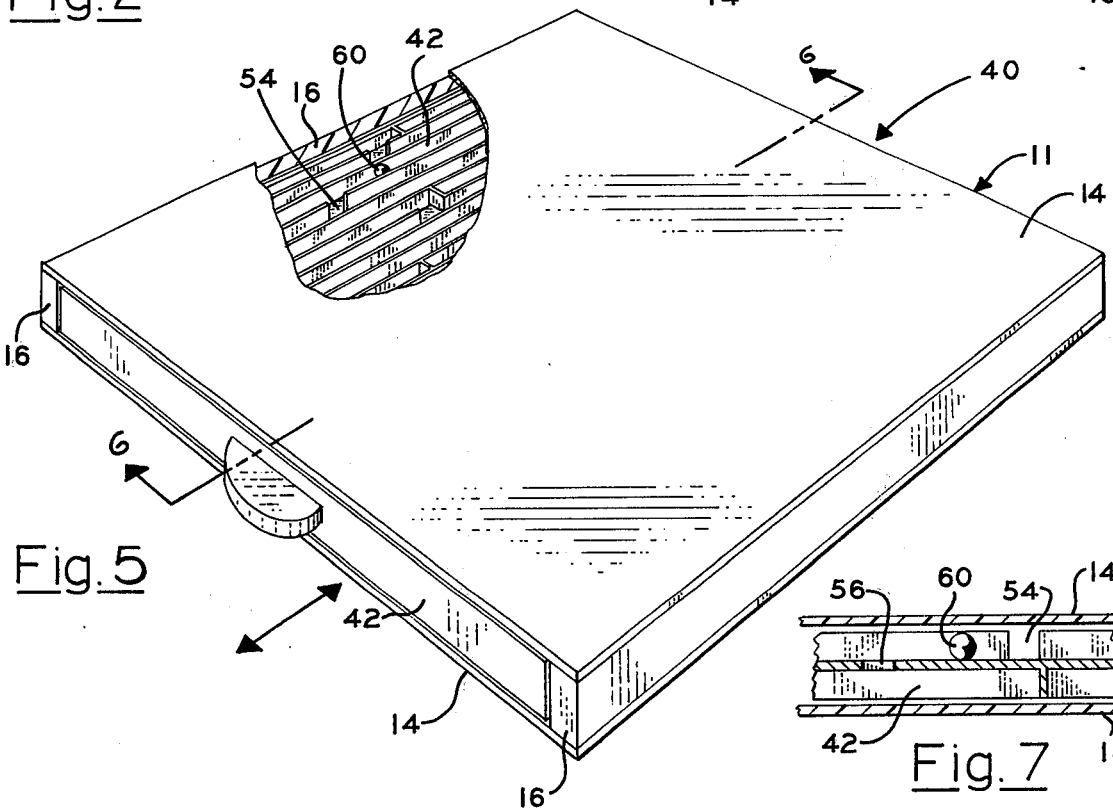
Fig. 5
Fig. 7
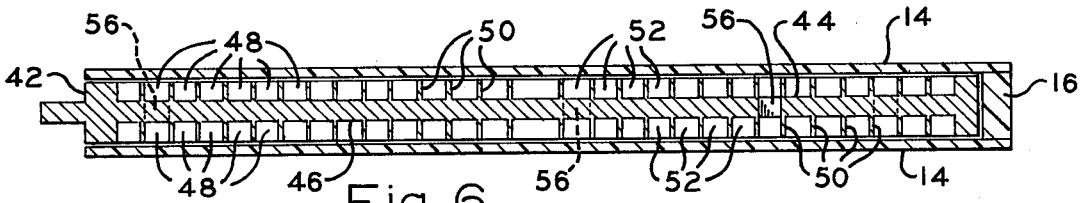
Fig. 6

AMUSEMENT DEVICE

BACKGROUND OF THE INVENTION

1. Field of the Invention

The invention generally relates to amusement devices and more particularly to an amusement device comprising a maze including a card having a singular path extended along opposite faces of the card, passing at least once through the card, whereby a player is required to play both sides of the card in order to traverse the path.

2. Description of the Prior Art

The prior art is, of course, replete with amusement devices based upon the principle of a maze. As can be appreciated a maze takes various forms. Frequently, amusement devices which utilize the principle of a maze, are those which utilize a card having a myriad of path segments, only a portion of which define a path along a face of the card. While such devices are fascinating and tend to challenge and amuse players, the level of difficulty remains substantially fixed due to the fact that after a period of practice, it is possible to analyze a maze while viewing it in its entirety.

It is, therefore, the general purpose of the instant invention to provide a maze having an increased level of difficulty requiring of players skills of levels greater than those required in analyzing mazes of known devices without departing from the principles of the known maze.

OBJECTS AND SUMMARY OF THE INVENTION

It is, therefore, an object of the instant invention to provide an improved amusement device.

It is another object to provide an improved amusement device characterized by a maze having an increased level of difficulty.

Another object is to provide an improved amusement device including a transparent envelope, a maze card disposed within the envelope and having a singular path defined by a first and second plurality of path segments extended along the first and second faces of the card, and a plurality of gates interconnecting the first and second plurality of segments and the segments of each plurality.

It is another object to provide an improved amusement device including a maze card having a maze path comprising a first plurality of interconnected path segments arranged on one face of the card, and a second plurality of interconnected path segments arranged on the opposite side of the card, and means defining at least one gate through the card for interconnecting the path segments, whereby there is provided a singular path which traverses the maze between its periphery and its center and passes at least once through the card.

Another object is to provide an improved maze including a card having a path segment defined on each of its opposite faces interconnected via a gate extended through the card, and a transparent envelope for receiving the card, whereby a player is afforded visual access to opposite faces of the card for facilitating a tracing of the maze along a singular path extended between the periphery and the center thereof, passing at least once through the card.

Another object is to provide an amusement device formed of channular segments arranged on opposite faces of a maze card and interconnected by apertures forming gates, and a ball seated within a segment adapted to pass through the gate for traversing a path, comprising selected segments extended between the periphery and the center of the maze and passing at least once through the card.

These together with other objects and advantages will become more readily apparent by reference to the following description and claims in light of the accompanying drawings.

BRIEF DESCRIPTION OF THE DRAWINGS

FIG. 1 is a fragmented perspective view of an amusement device constituting a first embodiment of the invention which includes a transparent envelope having a maze card received therein.

FIG. 2 is a cross-sectional view taken generally along line 2—2 of FIG. 1.

FIG. 5 is a fragmented perspective view of an alternate embodiment of the invention.

FIG. 6. is a cross-sectional view taken generally along line 6—6 of FIG. 5.

FIG. 7 is a fragmentary, cross-sectional view illustrating, on an enlarged scale, the embodiment of the invention depicted in FIG. 5.

DESCRIPTION OF THE PREFERRED EMBODIMENTS

Figure 3:
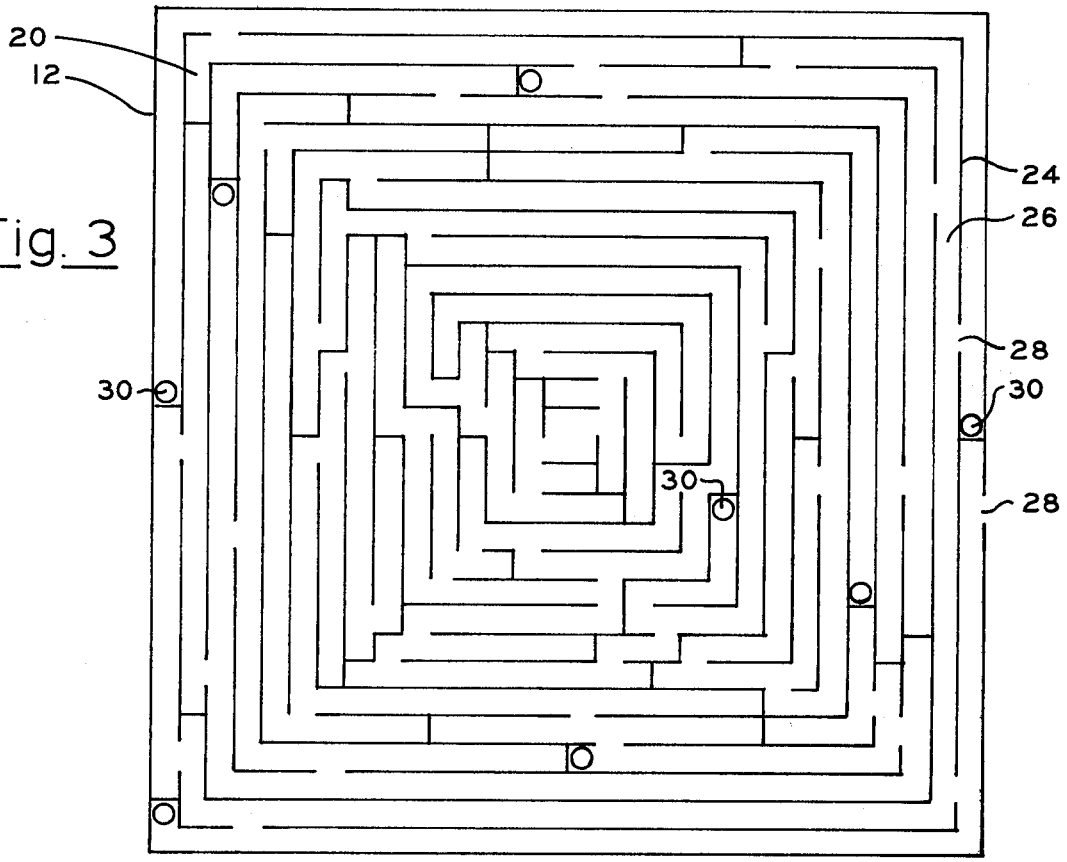
FIG. 3 is a top plan view of one face of the maze card shown in FIG. 1.

Referring now to the drawings wherein like reference characters designate like or corresponding parts throughout the several views, there is shown in FIG. 1 an amusement device, generally designated 10, which comprises one preferred embodiment of the instant invention.

The amusement device 10 includes an envelope 11 for receiving a maze card 12. The envelope includes a pair of planar windows 14 disposed in mutually spaced parallel planes. The windows 14 are formed of a rigid transparent material and are supported in spaced relation by a plurality of spacer bars 16. The spacer bars 16 extend along three edge portions of the envelope so that a slotted opening 18 is provided at the fourth edge portion of the envelope for facilitating insertion and extraction of the maze card 12.

Figure 4:
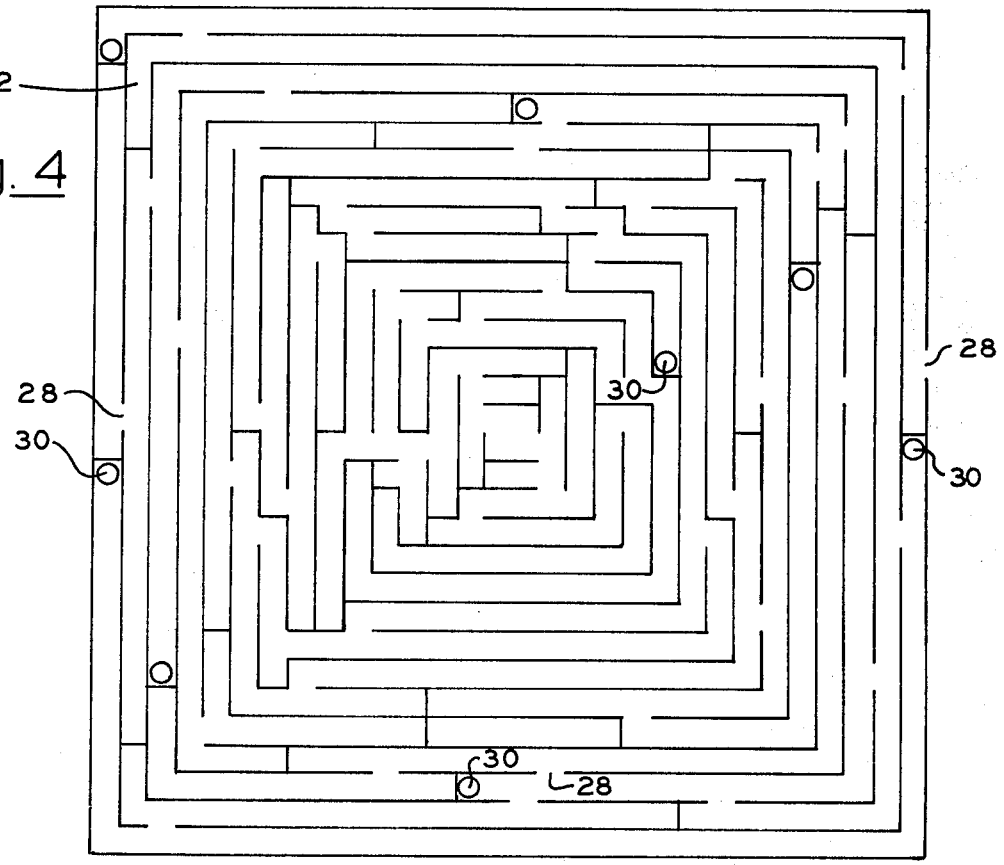
FIG. 4 is a bottom plan view of the maze card.

As best illustrated in FIGS. 3 and 4, the maze card 12 includes a first planar face 20 and a second planar face 22. On each of the faces of the maze card 12, there is provided a plurality of lines 24 which serve to define thereon a myriad of path segments 26. As should be apparent, selected path segments of the myriad of segments are interconnected via a plurality of gates, designated 28, which permit a player to simulate passage from one path segment 26 to another. Of course, many of the gates 28 lead to "dead ends" while others collectively unite the segments into a singular path, in a manner consistent with that of known maze pattern. As shown, the path segments 26 are arranged in patterns, each being the mirror image of the other. However, such an arrangement is not necessarily desirable, particularly where an increased of difficulty is sought.

However, it is important to note that included in the path segments 26 there is a plurality of gates 30 through which access between the opposite faces is facilititated. Hence, the united path segments 26 which appear at opposite faces of the maze card and collectively define a singular path also are interconnected by the gates 30 for thus completing a singular path which extends between the periphery of the maze and the center thereof and passes at least once through the maze card 12. Where desired, the lines 24 are so arranged that a singular path is defined by the path segments 26, gates 28 and gates 30 which passes through the card several times so that a player must traverse portions of the singular path along the faces of the card several times before completing passage through the maze. Moreover, it will be appreciated that the gates designated 30 are formed by registered indicia printed on the faces 20 and 22, however, where desired, apertures are employed equally as well for this purpose.

As illustrated in FIG. 1, the amusement device includes a marking device 32 such as a grease pencil, chalk, crayon or the like which can readily be employed to apply removable marks on the surface of the windows 14.

In "playing" the amusement device 10, illustrated in FIGS. 1 through 4, a player simply traces on the surface of a first window 14 a continuous path passing along the path segments 26, through the gates 28 and upon reaching an appropriate gate 30, terminates the marking on the first window, reverses the envelope 11 and resumes tracing on the opposite window, at the point opposite the gate 30 at which tracing of the path on the first window terminates. This process is repeated for as long as is necessary to traverse a singular path extended between the periphery of the maze defined on the maze card 12 and its center.

Referring now to FIGS. 5, 6 and 7, there is shown an amusement device 40 which constitutes an alternate embodiment of the invention. For the sake of convenience, the parts of the device 40 which correspond to the parts previously discussed in connection with the description of the embodiment shown in FIGS. 1 through 5 are similarly numbered. Therefore, it is to be understood that the amusement device 40 includes an envelope 11 having mutually spaced transparent windows 14. The windows 14 are provided at each of the opposite sides of the envelope while spacer bars 16, as shown in FIGS. 5 and 6, are interposed therebetween along three peripheral edge portions of the envelope 11. As can readily be seen, however, the spacer bars 16 have a thickness dimension somewhat greater than the thickness dimension of the spacer bars 16 shown in FIGS. 1 and 2. The resulting additional thickness of the spacer bars 16 is to afford insertion of a maze card, designated 42 into the envelope.

The maze card 42 includes at a first and a second face, designated 44 and 46, respectively, having a plurality of path segments 48 defined thereon. If desired, the faces 44 and 46 may constitute mirror images, each of the other, as hereinbefore described with respect to the faces 20 and 22 of the maze card 12.

The path segments 48 are defined by a plurality of upstanding walls 50 arranged in parallelism for forming channels 52, which, in turn, are interconnected through a plurality of gates 54. Selected segments 48 are interconnected to form a singular channular path, along each of the opposite sides of the maze card 42, while other segments lead to "dead ends", in a manner similar to that hereinbefore described in connection with the description of the maze card 12.

Also included in the maze card 42, is a plurality of apertures which form gates, designated 56, extended through the card 42 for interconnecting the paths formed foward along the opposite sides of the maze card. The dimensions of the gates 54 and 56 are such as to accommodate passage of a ball 60 which is disposed within the channels 52. Consequently, a ball 60 is afforded access between the path segments via the gates 54 and 56.

In view of the foregoing, it should be apparent that when employing the amusement device 40 a player simply tilts the envelope 11 in directions which permit the balls 60 to roll along the channels 52 until a singular path extended between the periphery of the maze and the center thereof, passing at least once to the maze card 42 via a gate 56, is traversed.

When employing the amusement device 10, a player using the marking device 32 traces a path beginning at one end thereof, on the windows 14, immediately above path segments 26 passing through the gates 28 and 30 until the opposite end of the path has been reached. Of course, the amusement device 10 can be employed or "played" when starting at either end of the path. Further, while not illustrated, it should be apparent that the terminals of the path of the maze may be disposed at locations other than at the periphery and the center of the maze. For example, the path of the maze may extend between spatially related points located along the periphery of the maze, or at intermediately related locations.

When employing or playing the amusement device 40 a player simply tilts the envelope 11 in a direction suitable for causing the ball 60 to roll along selected path segments 48, through selected gates 54, and at least one of the gates 56, until a singular path has been traversed by the ball between the periphery of the maze to the center thereof. Again, if desired, the player may begin by having the ball positioned at either end of the path.

It should be apparent that the maze cards 12 and 42 are replaced, as desired, with maze cards having other path arrangements for thus enhancing the level of difficulty by avoiding familiarity with a particular maze card.

In view of the foregoing, it should readily be apparent that the amusement device which embodies the principles of the instant invention is characterized by an increase level of difficulty capable of challenging players of substantial skill.

Although the invention has been herein shown and described in what are conceived to be the most practical and preferred embodiments, it is recognized that departures may be made therefrom within the scope of the invention, which is not to be limited to the illustrative details disclosed.

Having described my invention, what I claim as new and desire to secure by Letters Patent is:

1. An amusement device comprising in combination:

an envelope including a pair of mutually spaced walls defining therebetween a card-receiving space, each of said walls being formed of a substantially rigid transparent material and characterized by a pair of oppositely related planar surfaces;

a maze card having a pair of planar, oppositely related faces removably disposed between the walls of said envelope and characterized by indicia defining on the faces on integral maze comprising a labyrinth of contiguously related path segments visually apparent through each wall of said pair of walls, first gate means joining contiguous path segments defined on faces of said card common thereto, and second gate means joining segments defined on opposite faces of the card for establishing a singular, obfuscated path extending from the periphery of the card to its center and passing at least once through the card; and path tracing means including a marking device for applying removable tracing marks to the surfaces of said walls.

2. The amusement device of claim 1 wherein the indicia includes straight lines arranged in both parallel intersecting relationships, the first gate means includes hiatus defined in selected straight lines, and said second gate means includes registered indicia printed on the opposite faces of the card.

* * * * *